US007725058B2

(12) United States Patent
Kwon et al.

(10) Patent No.: US 7,725,058 B2
(45) Date of Patent: May 25, 2010

(54) DEVELOPING UNIT AND IMAGE FORMING APPARATUS HAVING THE SAME

(75) Inventors: Se-il Kwon, Seoul (KR); In-cheol Jeon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 208 days.

(21) Appl. No.: 12/115,006

(22) Filed: May 5, 2008

(65) Prior Publication Data

US 2009/0074466 A1 Mar. 19, 2009

(30) Foreign Application Priority Data

Sep. 14, 2007 (KR) ..... 10-2007-0093892
Mar. 19, 2008 (KR) ..... 10-2008-0025617

(51) Int. Cl.
*G03G 15/08* (2006.01)

(52) U.S. Cl. ..... 399/252

(58) Field of Classification Search ..... 399/102, 399/103, 106, 110, 111, 119, 252–259
See application file for complete search history.

(56) References Cited

U.S. PATENT DOCUMENTS 5,027,156 A 6/1991 Kobayashi
5,749,026 A 5/1998 Goldie
6,944,414 B2 * 9/2005 Harumoto et al. ..... 399/103
7,206,534 B2 * 4/2007 Murakami ..... 399/103
2002/0131789 A1 9/2002 Yokoi et al.
2005/0095028 A1 5/2005 Lee et al.
2005/0117937 A1 6/2005 Jeon
2005/0169675 A1 8/2005 Sato et al.

FOREIGN PATENT DOCUMENTS

EP 0 738 937 10/1996
JP 59170868 9/1984
JP 02-139587 5/1990
JP 05011619 A * 1/1993
JP 11-352777 12/1999

OTHER PUBLICATIONS

European Search Report dated Jan. 12, 2009 issued in EP 08160561.0.

* cited by examiner

*Primary Examiner*—David P Porta
*Assistant Examiner*—Kiho Kim
(74) *Attorney, Agent, or Firm*—Stanzione & Kim LLP

(57) ABSTRACT

A developing unit capable of dispersing a pressure of developer used therein includes a developer housing to contain the developer and a blocking member to divide the developer housing into a first section and a second section, the second section including a developing member disposed therein to transfer the developer onto a photosensitive medium and to store the developer, the blocking member being detachably mounted in the developing unit. When the blocking member is detached from the developing unit, the first section is connected to the second section, so that the pressure of developer inside the developer housing can be spread evenly.

29 Claims, 4 Drawing Sheets

DEVELOPING UNIT AND IMAGE FORMING APPARATUS HAVING THE SAME

CROSS-REFERENCE TO RELATED APPLICATIONS

This application claims priority under 35 U.S.C. §119 (a) of Korean Patent Application Nos. 10-2007-0093892, filed on Sep. 14, 2007, and 10-2008-0025617, filed on Mar. 19, 2008, in the Korean Intellectual Property Office, the disclosure of which is incorporated herein by reference in its entirety.

BACKGROUND OF THE INVENTION

1. Field of the Invention

The present general inventive concept relates to an image forming apparatus utilizing an electrophotographic process, and more particularly, to a developing unit capable of evenly spreading pressure of a developer and preventing the developer from being scattered, and an image forming apparatus having the developing unit.

2. Description of the Related Art

Image forming apparatuses utilizing electrophotographic processes perform operations such as charging, exposing, developing, transferring and fixing in order to form images. Developing units within the image forming apparatus function to develop electrostatic latent images formed on photosensitive media using a developer. Developing units include developer housings containing developer, and developing rollers. The developer contained in the developer housings is attached to developing rollers, and a developing gap of a predetermined distance is formed between the developing rollers and photosensitive media. Electrostatic forces generated by a potential difference between the developing rollers and photosensitive media cause the developer attached to developing rollers to move to photosensitive media through the developing gap, so that visual images corresponding to the electrostatic latent images are formed.

There are two types of developing units, one of which is manufactured with developer pre-supplied to developer housings, and the other one of which does not have the developer pre-supplied.

In the case of a developing unit in which developer is not pre-supplied to developer housings, it is impossible to check whether the developing unit is of inferior quality after the developing unit has been manufactured, since there is no developer in the developing unit with which to perform a print test.

In the case of a developing unit in which developer is pre-supplied, it is possible to sort out defective products by performing a print test. However, problems may arise during distribution before the developing units reach customers.

Developer as powders have an adhesive quality, and thus if a developing unit is placed in an upright position for a long period of time or is transported a long distance, the developer particles may become coagulated on one side of the developing unit. Accordingly, the pressure of the developer particles may increase, and the torque required to transfer the developer particles may increase excessively due to the coagulated developer particles. Therefore, the load on a motor may become excessive, causing the motor to be unable to rotate, and making it impossible for printing to be performed.

A developing roller rotates while a developing unit is being operated, causing airflow to be generated in a developing gap between the developing roller and a photosensitive medium, and accordingly, some developer scatters outwards from the developing unit in the direction of the airflow rather than moving onto the photosensitive medium. Additionally, a portion of the airflow formed in the developing gap flows into a developer housing, so the air pressure inside the developer housing becomes greater than the air pressure outside the developer housing. Such a difference in air pressure may cause a greater amount of developer to be scattered, and an image forming apparatus and printing media may thus be contaminated due to the scattered developer.

In order to prevent the scattering of developer, it is necessary for the air pressure in the developer housing to be reduced. To achieve this, there is provided a conventional developer housing including a filter and an air vent hole formed therein. The filter only allows air to pass through while preventing the developer from passing through. However, fine developer particles having a diameter less than that of pores formed on the filter are able to flow out through the air vent hole. If a developing unit is attached to an image forming apparatus, there is a small possibility that fine developer particles flow out. However, since shocks or vibrations may be applied to the developing unit during distribution before the developing units reach customers, the outflow of fine developer particles may increase.

SUMMARY OF THE INVENTION

The present general inventive concept provides a developing unit which has an improved structure to evenly spread a pressure of developer stored in the developing unit and to prevent the developer from being scattered.

The present general inventive concept also provides an image forming apparatus having the developing unit in which it is possible to perform printing smoothly.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a developing unit including: a developer housing to contain a developer; and a blocking member to divide the developer housing into a first section and a second section, which includes a developing member disposed therein to transfer the developer onto a photosensitive medium and stores the developer, the blocking member being detachably mounted in the developing unit.

When the blocking member is detached from the developing unit, the first section may be connected to the second section, so that a pressure of the developer inside the developer housing may be spread evenly.

The blocking member may be formed of a film.

The first section may extend lengthwise along the developing unit. There may be two or more first sections disposed at different positions.

A developer transfer device may be disposed in the second section. The developer transfer device may include an auger.

An air vent may be formed in the first section.

A filter member may be disposed in the first section to prevent the developer from flowing out via the air vent.

The developing unit may further include a developing member to develop the electrostatic latent image formed on the photosensitive medium using the developer, and a scatter preventing member to cause airflow to be generated in a direction opposite the direction of airflow formed between the photosensitive medium and the developing member.

The foregoing and/or other aspects and utilities of the present general inventive concept may also be achieved by providing a developing unit including a developer housing including a first section and a second section, and a blocking member removably disposed between the first section and second section, such that when the blocking member is removed from the developing unit, developer stored in one of the first section and the second section is free to move to the other one of the first section or second section to reduce the pressure of the developer within the one of the first section or the second section.

An air vent may be formed in one of the first section and the second section. A filter member may be disposed in one of the first section or second section to prevent the developer from flowing out via the air vent.

The foregoing and/or other aspects and utilities of the present general inventive concept may also be achieved by providing a developing unit including a developer housing to contain a developer; an air vent formed on the developer housing; a filter member to prevent the developer from flowing out via the air vent; and a blocking member to divide the developer housing and the air vent, the blocking member being detachably mounted in the developing unit.

The foregoing and/or other aspects and utilities of the present general inventive concept may also be achieved by providing an image forming apparatus including a photosensitive medium on which an electrostatic latent image is formed; a developing unit, as described above, to develop the electrostatic latent image using a developer; a transferring unit to transfer a developer image on the photosensitive medium developed by the developing unit onto a recording medium; and a fixing unit to fix the transferred developer image onto the recording medium.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
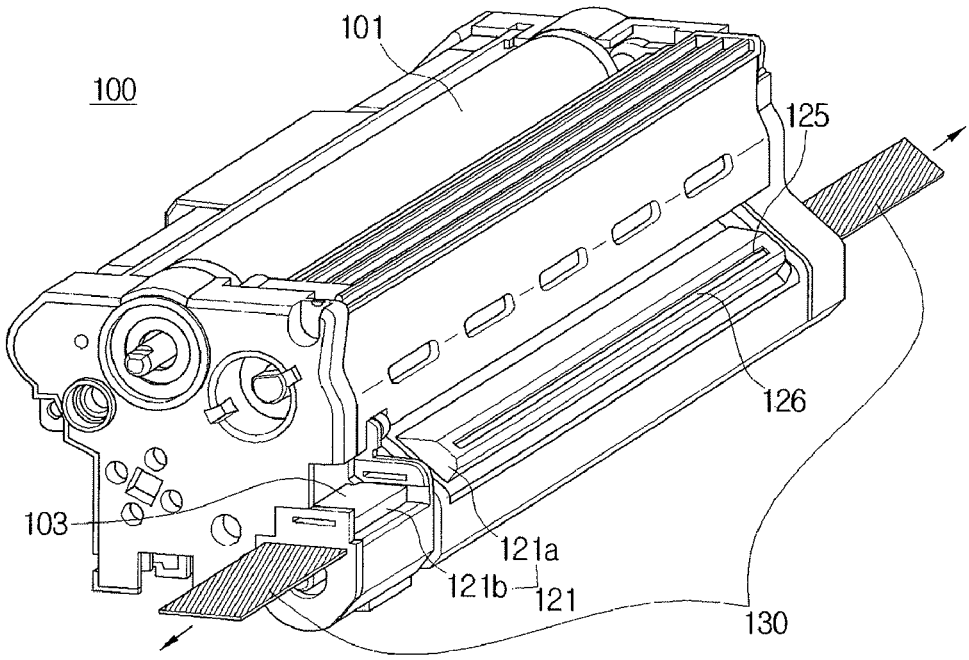
FIG. 1 is a perspective view illustrating a developing unit according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
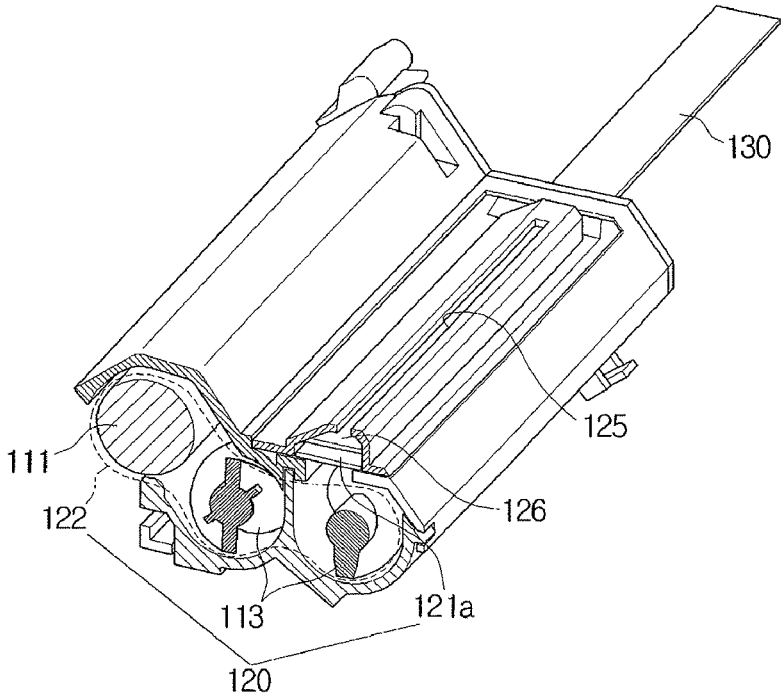
FIG. 2 is a fragmentary perspective view illustrating the developing unit of FIG. 1.
Figure 3:
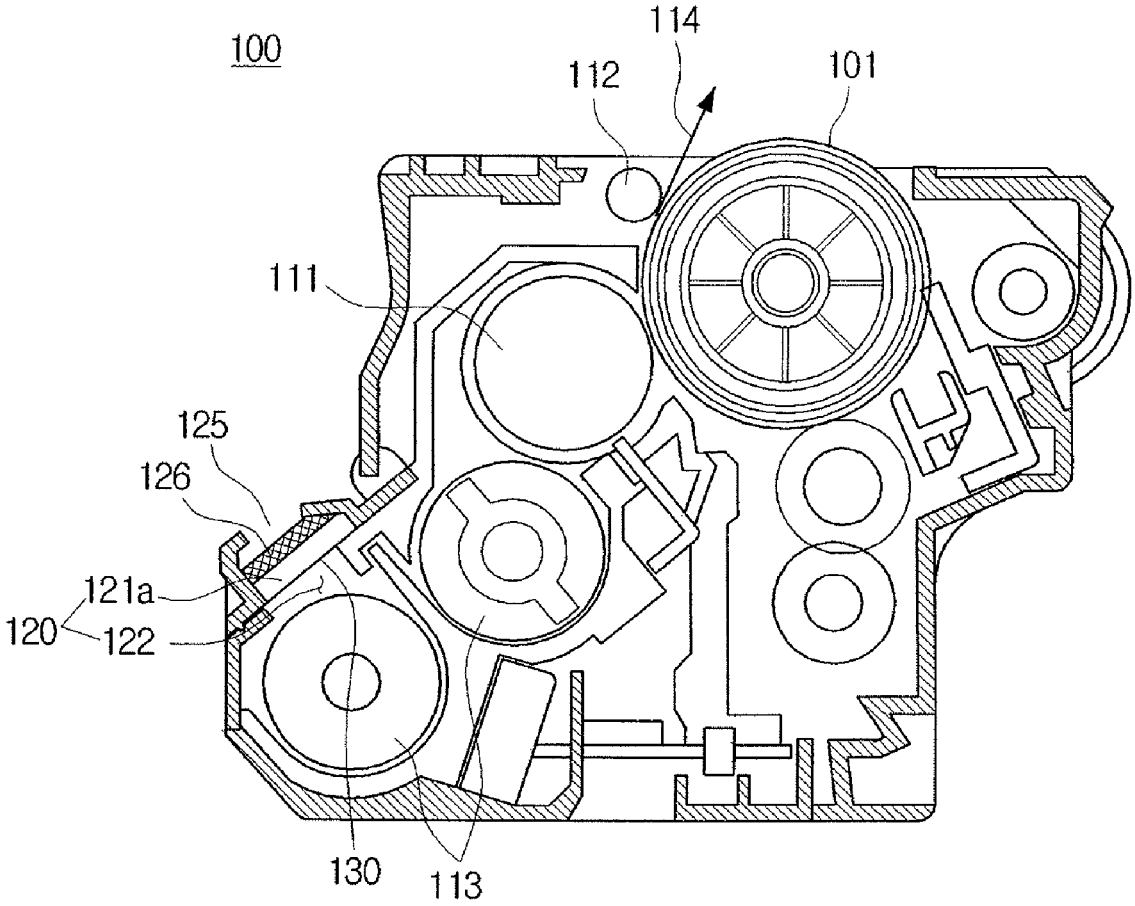
FIG. 3 is a cross-sectional view illustrating the developing unit of FIG. 1.

FIG. 1 is a perspective view illustrating a developing unit 100 according to an exemplary embodiment of the present general inventive concept, FIG. 2 is a fragmentary perspective view illustrating the developing unit 100, and FIG. 3 is a cross-sectional view illustrating the developing unit 100.

In this exemplary embodiment, the developing unit 100 includes a photosensitive medium 101, a developing member 111, a scatter preventing member 112, a developer housing 120 and blocking members 130. The developing unit 100 according to the above exemplary embodiment employs a tandem method for convenience of description, but this should not be considered limiting.

An electrostatic latent image may be formed on the photosensitive medium 101 by light emitted from a laser scanning unit (not illustrated). The developing unit 100 in the above exemplary embodiment includes the photosensitive medium 101 and employs the tandem method in which a plurality of developing units are arranged for each color to form color images, but the developing unit 100 is not limited to such a configuration. Accordingly, the present general inventive concept is equally applicable to a multi-method in which a plurality of developing units 100 form images on a single photosensitive medium. In this situation, the photosensitive medium is not disposed in each developing unit 100 and the number of photosensitive media is less than that of the developing units 100.

The developing member 111 can coat the photosensitive medium 101, on which the electrostatic latent image is formed, with the developer contained in the developer housing 120. The developing member 111 may be formed as a roller, which is made of cylindrical rubber or metal, a belt or tubing. Additionally, if the developer exhibits magnetism, the developing unit 100 may include a kind of magnet.

Since the developing member 111 is not in contact with the photosensitive medium 101, toner, as a form of developer, jumps from the developing member 111 to the photosensitive medium 101 so that developing can be performed. Alternatively, the present general inventive concept is equally applicable to a situation in which the developing member 111 is in contact with the photosensitive medium 101.

The scatter preventing member 112 can cause airflow to be generated in a direction opposite to that of the airflow formed between the photosensitive medium 101 and the developing member 111, and can prevent the developer from being scattered outwards from the developing unit 100. The photosensitive medium 101 rotates in one direction, and the developing member 111 rotates in the opposite direction to the photosensitive medium 101, so airflow may be generated in a developing gap between the photosensitive medium 101 and the developing member 111. For example, if the photosensitive medium 101 rotates clockwise and the developing member 111 rotates counterclockwise, an upward airflow may be generated in the developing gap, as illustrated in FIG. 3. Accordingly, it may become impossible for a portion of the developer to move to the electrostatic latent image formed on the photosensitive medium 101, and thus the developer may be scattered outwards from the developing unit 100 along the upward airflow in a direction indicated by an arrow 114 shown in FIG. 3. In this situation, if the scatter preventing member 112 rotates clockwise, another airflow may be generated in a direction opposite that of the upward airflow formed in the developing gap. Therefore, it is possible to prevent the developer from being scattered outwards from the developing unit 100.

The developer housing 120 can be a space inside the developing unit 100 to store the developer. The developer housing 120 includes the developing member 111 and a developer transfer device 113. A shutter 103 can control the supply of the developer to the developer housing 120 in a developer cartridge (not illustrated). The shutter 103 may be required only when the developer cartridge is separated from the developing unit 100. The developer transfer device 113 can agitate the developer in the developer housing 120 and transfer the developer to the developing member 111 using the power transferred from a motor (not illustrated). In this exemplary embodiment, the developer transfer device 113 comprises an auger, but various types of developer transfer device 113 may be used.

The blocking member (or members) 130 can divide the developer housing 120 into a first section 121 and a second section 122. The first section 121 may be empty space, and the second section 122 may include the developing member 111.

If the developer has been previously supplied in the developer housing 120 when the developing unit 100 is initially manufactured, a print test can be performed when the developing unit 100 is completely manufactured. This test enables final verification of whether there are problems in the manufactured developing unit 100, so it is possible to reduce the proportion of defective developing units 100.

However, since the developer has an adhesive quality, developer particles may be coagulated during the circulation process. For example, if the developing unit 100 is placed in an upright position for a long period of time or is transported a long distance, the developer particles may lean to one side of the developer housing 120 and stick together.

Figure 4:
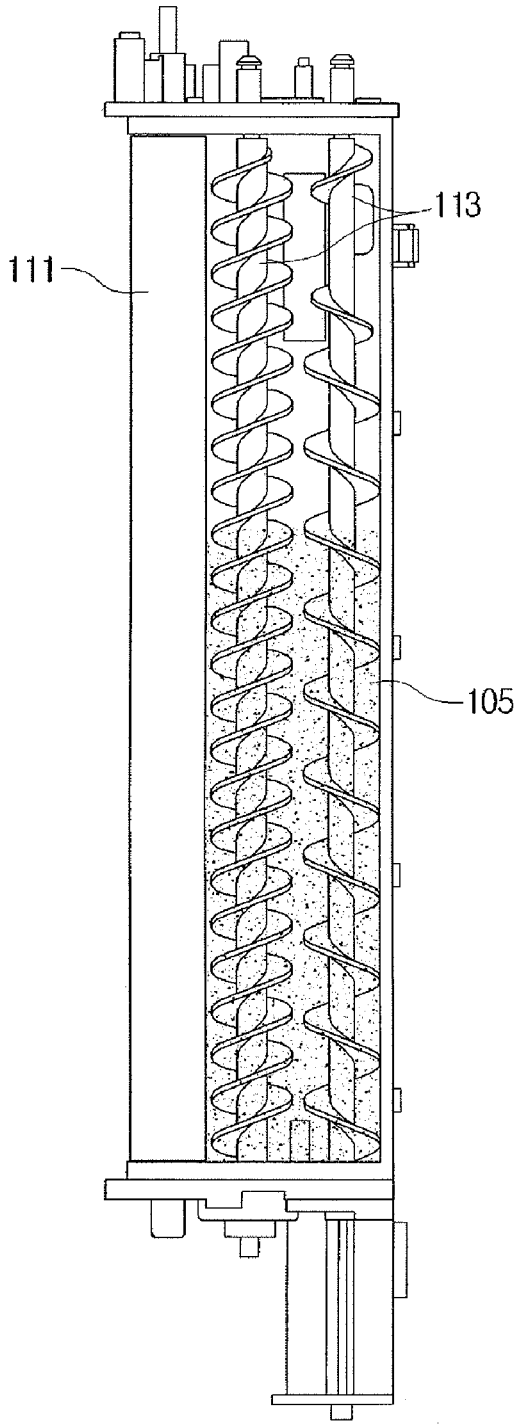
FIG. 4 is a schematic view illustrating the state of developer contained in the developing unit of FIG. 1 when the developing unit of FIG. 1 is placed in an upright position.

FIG. 4 illustrates a state of developer 105 being coagulated in the developing unit 100 when the developing unit 100 is placed in an upright position. If the developer 105 is coagulated as illustrated in FIG. 4, the torque required to drive the developer transfer device 113 will most likely increase. Accordingly, the load on the motor, which supplies the driving force, may be excessive, causing power consumption to increase. More seriously, the motor may be unable to rotate, making it impossible for the developer transfer device 113 to transfer the developer contained in the developer housing 120, so an image cannot be formed on a recording medium.

This is because the pressure of the developer inside the developer housing 120 reaches a high level. Specifically, the developer particles are coagulated at one side of the developer housing 120 rather than being evenly dispersed in the developer housing 120, so the pressure of the developer increases. Additionally, when the developer particles are coagulated at one side of the developer housing 120, there is no marginal space for the developer to move. Accordingly, a large resistance may be generated when the developer transfer device 113 is driven.

According to the exemplary embodiment, the blocking member 130 may be used to divide the developer housing 120 into the first section 121 and the second section 122, and thus it is possible to solve the problems described above. The first section 121 may be disposed adjacent to the second section 122, and may be empty. The blocking member 130 can separate the first section 121 and the second section 122, and can be detached from developing unit 100 using a predetermined force. Here, the blocking members 130 can be formed of a film, or can desirably be formed of an elastic material. However, any member capable of separating the first section 121 and the second section 122 may be used as the blocking member 130.

Figure 5:
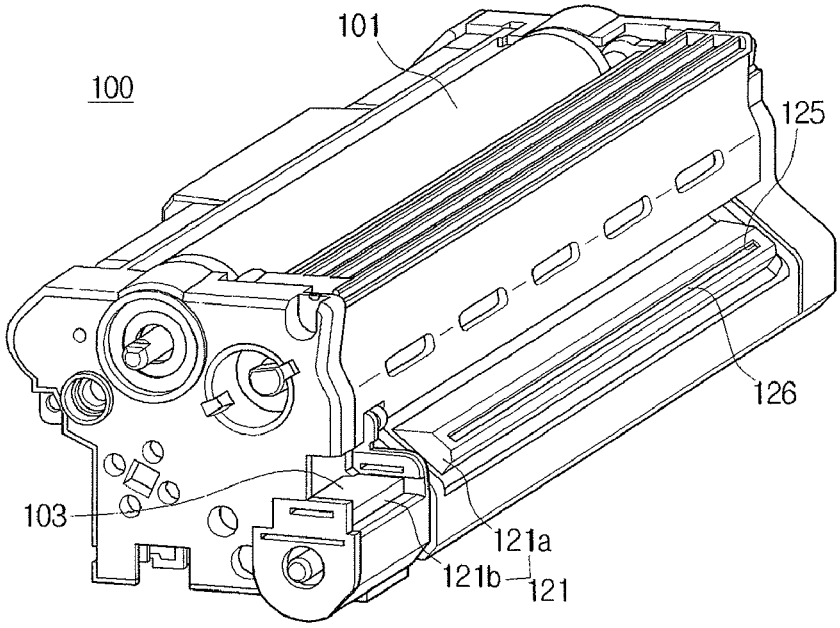
FIG. 5 is a perspective view illustrating the developing unit of FIG. 1 wherein there are no blocking members.

When the developing unit 100 is initially manufactured, only the second section 122 contains the developer and the first section 121 does not contain the developer, due to the blocking members 130. A user may buy the developing unit 100, attach the developing unit 100 to an image forming apparatus, and then remove the blocking members 130 in directions indicated by arrows illustrated in FIG. 1 before using the developing unit 100. FIG. 5 illustrates the developing unit 100 in the case that there are no blocking members 130.

If the blocking members 130 are removed, the first section 121 is connected to the second section 122. Accordingly, a portion of the developer 105 coagulated at one side of the developing unit 100 can flow into the first section 121, and thus the pressure of developer inside the developer housing 120 can be spread out more evenly. Additionally, this flow of the developer 105 creates some space in the second section 122 in which the coagulated developer 105 is contained, corresponding to the amount of developer flowing into the first section 121. Therefore, the torque required to drive the developer transfer device 113 can be reduced.

The first section 121 of the developer housing 120 can desirably extend lengthwise along the developing unit 100, as illustrated in FIG. 1. The coagulation of the developer usually arises when the developing unit 100 is placed in an upright position for a long period of time. Accordingly, if the developing unit 100 is laid down lengthwise in a horizontal position, there are no problems caused by coagulation of the developer.

The first section 121 of the developer housing 120 may be a single chamber traversing the developer housing 120. In this situation, only one blocking member 130 is needed, as illustrated in the embodiment of FIG. 2. Accordingly, the user can remove only the one blocking member 130 before attaching the developing unit 100 to the image forming apparatus 100, which increases convenience to the user. Alternatively, it is also possible for the first section 121 to have more than one chamber due to interference with other units or limitations of design. In this situation, two or more sections disposed at different positions may be used as the first section 121. In this exemplary embodiment, there may be two first sections 121*a* and 121*b*. One first section 121*a* may be disposed lengthwise along the developing unit 100, and the other first section 121*b* may be disposed adjacent to the shutter 103. If two or more first sections 121 are used, the number of blocking members 130 may also be two or more, corresponding to the number of first sections 121. Thus, a plurality of blocking members 130 are required to be removed before the developing unit 100 is attached to the image forming apparatus.

An air vent 125 is formed on the developer housing 120. Air is able to flow between the inside and outside of the developer housing 120 via the air vent 125, so the air pressure inside the developer housing 120 may be reduced, and it is thus possible to prevent developer from being scattered. Accordingly, the scatter preventing member 112 and the air vent 125 described above in this exemplary embodiment can significantly reduce the scattering of the developer.

A filter member 126 can prevent the developer contained in the developer housing 120 from flowing out through the air vent 125. Since air is able to pass through the filter member 126, but developer is unable to pass through the filter member 126, outflow of developer can be prevented and the air pressure inside the developer housing 120 can be reduced. Developer particles have different sizes. In other words, developer particles have a predetermined distribution in its size. Accordingly, fine developer particles having a diameter smaller than that of pores formed on the filter member 126 may flow out via the filter member 126. If the developing unit 100 is attached to the image forming apparatus, there is a little possibility of such outflow of fine developer particles. However, shocks or vibrations may be applied to the developing unit 100 during distribution before the developing unit 100 reaches customers, so fine developer particles may flow out from the developing unit 100 through the filter member 126.

According to this exemplary embodiment, the air vent 125 and the filter member 126 may be disposed in the first section 121, which is separated by the blocking member 130 from the second section 122 in which the developer is stored. Accordingly, even when shocks or vibrations are applied to the developing unit 100 during distribution before the developing unit 100 reaches customers, the blocking member 130 can prevent fine developer particles from flowing out. As described above, the user may attach the developing unit 100 to the image forming apparatus, and then remove the blocking members 130 from the developing unit 100 before using the developing unit 100. When the developing unit 100 is secured to the image forming apparatus, the outflow of fine developer particles becomes less important. If the blocking member 130 is removed, air is able to flow between the inside and outside of the developer housing 120 via the air vent 125, and the air pressure inside the developer housing 120 may thus be reduced, so that it is possible to prevent the developer from being scattered. While the air vent 125 and filter member 126 are disposed in the first section 121 according to the exemplary embodiment, the air vent 125 and filter member 126 may be disposed in another extra space in the developer housing 120. In this situation, another blocking member 130 may be mounted to separate the air vent 125 and the developer housing 120.

Additionally, the developing unit 100 may further include a detecting device (not illustrated) to detect whether the blocking member 130 is removed from the developing unit 100. If the user does not remove the blocking member 130 before using the developing unit 100, the problems described above may occur. Accordingly, the detecting device (not illustrated) can detect whether the blocking member 130 is removed, and can cause the user to remove the blocking member 130 before using the developing unit 100. For example, a detecting device may be a photo sensor to determine whether the blocking member 130 exists in the developing unit 100. If the photo sensor determines that the blocking member 130 exists before the developing unit 100 is used, the photo sensor may notify the user that the blocking member 130 needs to be removed using a display window and an alarm sound.

Figure 6:
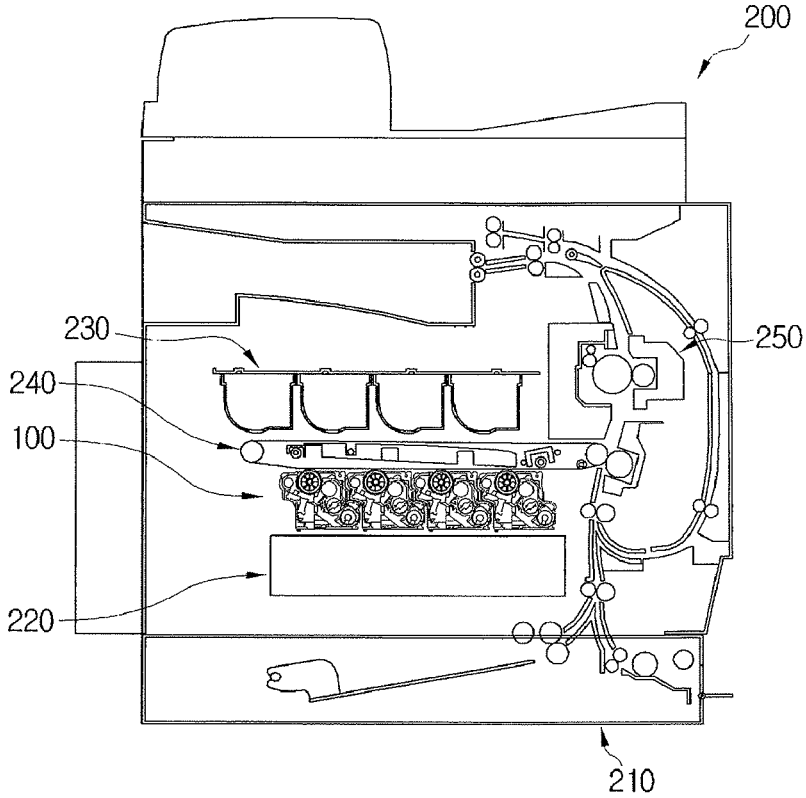
FIG. 6 is a cross-sectional view illustrating an image forming apparatus having a developing unit according to an exemplary embodiment of the present general inventive concept.

FIG. 6 schematically illustrates an image forming apparatus 200 having the developing unit 100 according to an exemplary embodiment of the present general inventive concept. The image forming apparatus 200 includes a feeding unit 210, a light scanning unit 220, a developer cartridge 230, a transferring unit 240, a fixing unit 250 and the developing unit 100 configured as described above.

The feeding unit 210 can house a recording medium on which an image is to be formed, and feed the recording medium into the image forming apparatus 200. The laser scanning unit 220 can form an electrostatic latent image on the photosensitive medium 101. The developer cartridge 230 can store developer, and supply the developer to the developing unit 100. The developing unit 100 can develop the photosensitive medium 101 on which the electrostatic latent image is formed, using the developer, and the transferring unit 240 can transfer the developer image developed by the developing unit 100 onto the recording medium. The fixing unit 250 can then fix the transferred developer image onto the recording medium, and the recording medium onto which the developer image is fixed may be subsequently discharged to the outside of the image forming apparatus 200, completing the printing operation.

According to the exemplary embodiments described above, it is possible to evenly spread the pressure of the developer inside the developing unit, and thus the torque required to transfer the developer can be reduced.

Additionally, it is possible to perform printing smoothly even when developer particles become coagulated during the distribution of the developing unit.

Furthermore, it is possible to prevent the image forming apparatus from being contaminated due to the scattering of developer, and minimize the outflow of developer that occurs during distribution of the developing unit.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing unit comprising:

a developer housing to contain a developer; and a blocking member to divide the developer housing into a first section and a second section, which comprises a developing member disposed therein to transfer the developer onto a photosensitive medium and to store the developer, the blocking member being detachably mounted in the developing unit.

2. The developing unit of claim 1, wherein, when the blocking member is detached from the developing unit, the first section is connected to the second section, so that a pressure of the developer inside the developer housing is spread evenly.

3. The developing unit of claim 2, wherein the blocking member is formed of a film.

4. The developing unit of claim 1, wherein the first section extends lengthwise along the developing unit.

5. The developing unit of claim 4, wherein two or more first sections are disposed at different positions.

6. The developing unit of claim 1, wherein a developer transfer device is disposed in the second section.

7. The developing unit of claim 6, wherein the developer transfer device comprises an auger.

8. The developing unit of claim 1, wherein an air vent is formed in the first section.

9. The developing unit of claim 8, wherein a filter member is disposed in the first section to prevent the developer from flowing out via the air vent.

10. The developing unit of claim 1, further comprising:

a scatter preventing member to cause airflow to be generated in a direction opposite the direction of airflow formed between the photosensitive medium and the developing member.

11. A developing unit comprising:

a developer housing to contain a developer;

an air vent formed on the developer housing;

a filter member to prevent the developer from flowing out via the air vent; and a blocking member to divide the developer housing and the air vent, the blocking member being detachably mounted in the developing unit.

12. The developing unit of claim 11, further comprising:

a developing member to develop an electrostatic latent image formed on the photosensitive medium using the developer; and a scatter preventing member to cause airflow to be generated in a direction opposite the direction of airflow formed between the photosensitive medium and the developing member.

13. An image forming apparatus comprising:

a developing unit to develop a photosensitive medium, on which an electrostatic latent image is formed, using a developer;

a transferring unit to transfer a developer image on the photosensitive medium developed by the developing unit onto a recording medium; and a fixing unit to fix the transferred developer image onto the recording medium, wherein the developing unit comprises:

a developer housing to contain a developer; and a blocking member to divide the developer housing into a first section and a second section, which comprises a developing member disposed therein to transfer the developer onto a photosensitive medium and store the developer, the blocking member being detachably mounted in the developing unit.

14. The image forming apparatus of claim 13, wherein, when the blocking member is detached from the developing unit, the first section is connected to the second section, so that a pressure of the developer inside the developer housing is spread evenly.

15. The image forming apparatus of claim 14, wherein the blocking member is formed of a film.

16. The image forming apparatus of claim 13, wherein the first section extends lengthwise along the developing unit.

17. The image forming apparatus of claim 16, wherein two or more first sections are disposed at different positions.

18. The image forming apparatus of claim 13, wherein a developer transfer device is disposed in the second section.

19. The image forming apparatus of claim 18, wherein the developer transfer device comprises an auger.

20. The image forming apparatus of claim 13, wherein an air vent is formed in the first section.

21. The image forming apparatus of claim 20, wherein a filter member is disposed in the first section to prevent the developer from flowing out via the air vent.

22. The image forming apparatus of claim 13, further comprising:

a scatter preventing member to cause airflow to be generated in a direction opposite the direction of airflow formed between the photosensitive medium and the developing member.

23. A developing unit comprising:

a developer housing including a first section and a second section; and a blocking member removably disposed between the first section and second section, such that when the blocking member is removed from the developing unit, developer stored in one of the first section and the second section is free to move to the other one of the first section or second section to decrease a pressure of the developer within the one of the first section or the second section.

24. The developing unit of claim 23, wherein the blocking member comprises:

a first blocking member and a second blocking member each separately removable from the developing unit such that when one of the first blocking member or the second blocking member is removed, the developer stored in the one of the first section and the second section can move to only a corresponding portion of the other one of the first section or the second section with respect to the first blocking member and the second blocking member.

25. The developing unit of claim 24, wherein the other one of the first section and the second section of the developer housing is separated into a first part corresponding to the first blocking member and a second part corresponding to the second blocking member.

26. The developing unit of claim 25, wherein the first blocking member and the second blocking member are equal in length, and the first part and the second part of the developer housing are equal in volume.

27. The developing unit of claim 25, wherein the first blocking member and the second blocking member are a different length with respect to each other, and the first part and the second part of the developer housing are different in volume with respect to each other.

28. The developing unit of claim 23, wherein an air vent is formed in one of the first section or second section.

29. The developing unit of claim 28, wherein a filter member is disposed in one of the first section or second section to prevent the developer from flowing out via the air vent.

* * * * *